United States Patent [19]

Klebe, Jr. et al.

[11] 3,950,625

[45] Apr. 13, 1976

[54] SAFETY SWITCH FOR DRILL PRESS USING CHUCK KEY

[75] Inventors: Elmer C. Klebe, Jr., Easley; Timothy J. Looper, Pickens, both of S.C.

[73] Assignee: The Singer Company, New York, N.Y.

[22] Filed: Apr. 17, 1975

[21] Appl. No.: 569,136

[52] U.S. Cl. ..... 200/61.58 R; 200/42 R; 200/52 R; 408/710

[51] Int. Cl.[2] ..... H01H 27/06

[58] Field of Search..... 408/241, 710; 200/61.58 R, 200/42 R, 52 R

[56] References Cited

UNITED STATES PATENTS

| | | | |
|---|---|---|---|
| 2,597,969 | 5/1952 | Barton | 200/44 |
| 2,666,104 | 1/1954 | Griffin | 200/61.58 R |
| 2,713,407 | 7/1955 | Miller | 408/241 |
| 2,807,732 | 9/1957 | Kurtovich | 279/1 R |
| 3,761,654 | 9/1973 | Davis | 200/61.58 R |
| 3,769,473 | 10/1973 | Lay | 200/61.58 R |

*Primary Examiner*—Robert L. Spruill
*Attorney, Agent, or Firm*—Robert E. Smith; Edward L. Bell; Harold Weinstein

[57] ABSTRACT

The subject safety switch insures that the chuck key has been removed from the chuck prior to operation of the drill press. A slide "on-off" switch is engaged by a guard that prevents the sliding movement necessary to turn the switch on. The guard of the safety switch is not part of the electrical circuit, but rather is a mechanical addition which prevents operation of the electrical circuit. The socket is formed in the housing adjacent the guard. The chuck key is inserted into the socket to engage the guard and remove it from the path of travel of the switch to permit the switch to be shifted between the on and off position. The socket is keyhole shaped, whereby insertion of the chuck key therein will force the chuck to seat within the lower narrower aperture thereof.

3 Claims, 5 Drawing Figures

SAFETY SWITCH FOR DRILL PRESS USING CHUCK KEY

BACKGROUND OF THE INVENTION

Heretofore in the prior art, various safety switches have been used to prevent accidental starting of the power tool. However, whenever a chuck key was used in the safety switch, it would be to make or break the actual circuit contacts of the safety switch. A second on-off switch was required to operate the power tool. The use of a second safety switch was disadvantageous in that it was another component which added to the cost and complexity of the tool and might itself adversely affect the safe operation of the tool by permitting the insertion of the chuck keys at such times when the on-off switch was in the on position, thus the safety switch would be actuated by the insertion of the chuck key to suddenly start the power tool.

SUMMARY OF THE INVENTION

It is therefore an object of the present invention to provide an improved safety switch for a drill press using a chuck key which overcomes the prior art disadvantages; which is simple, economical and reliable; which uses a mechanical guard to prevent operation of the switch from the off to the on position unless the chuck key has been inserted to remove said guard; which uses a safety switch embodied with the on-off switch; which uses a spring guard normally to prevent actuation of the switch; which uses a spring guard which coacts with a socket to prevent actuation of the switch; and which uses a socket to seat the chuck keys therein upon removal of the spring guard to permit normal operation of the switch.

Other objects and advantages will be apparent from the following description of one embodiment of the invention, and the novel features will be particularly pointed out hereinafter in the claims.

BRIEF DESCRIPTION OF THE DRAWINGS

This invention is illustrated in the accompanying drawings in which.

DESCRIPTION OF THE INVENTION

Figure 1:
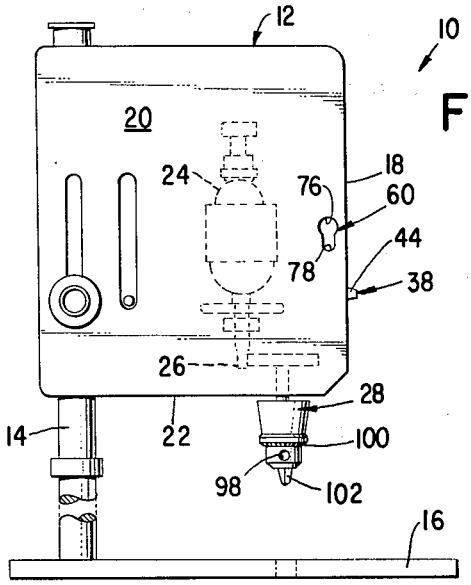
FIG. 1 is a side elevational view of a drill press embodying the present invention.

In the illustrated embodiment of the invention, a drill press, designated generally 10, is shown in FIG. 1. The drill press 10 has a housing 12 carried on a standard 14 affixed to a frame 16. The housing 12 includes a front wall 18, a side wall 20 and a bottom wall 22. An electric motor 24 is journaled in the housing and is operated to a power a gear train 26 which drives an externally disposed chuck 28 which extends from the bottom wall 22 in superposition to the frame 16, as illustrated in FIG. 1.

Figure 3:
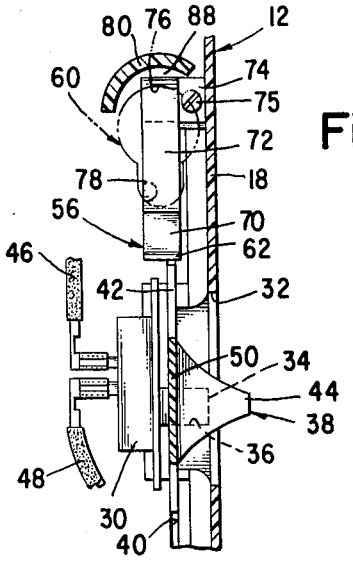
FIG. 3 is a side elevational view, partly in section, taken along line 3—3 of FIG. 2.
Figure 2:
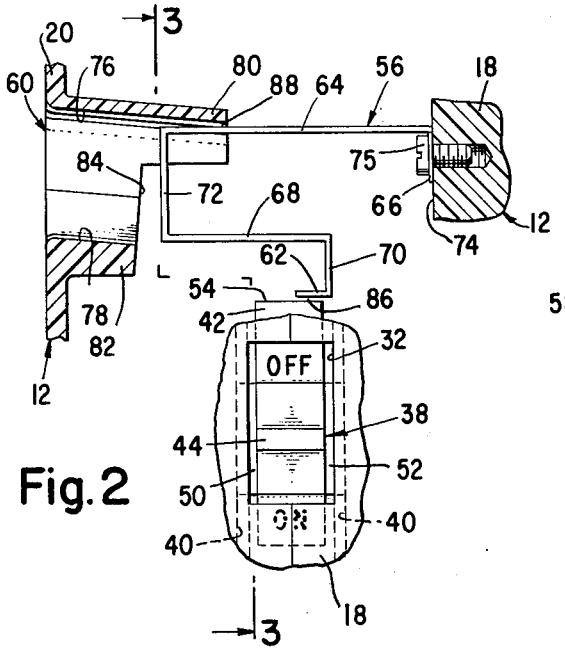
FIG. 2 is a fragmented front elevational view, partly in section, showing the safety switch of the present invention.
Figure 4:
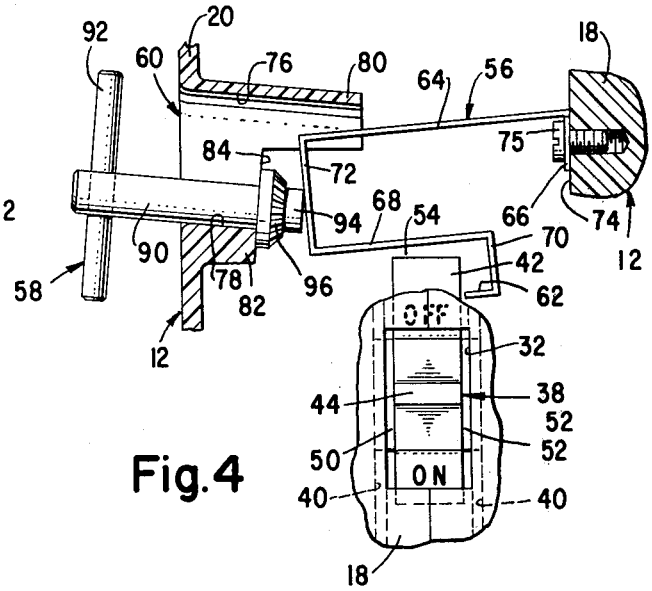
FIG. 4 is a fragmented front elevational view, partly in section, showing the key chuck seated within the socket to remove the guard from the path of travel of the on-off switch, thus permitting it to be actuated.

A switch 30 shown in FIG. 3 is fixedly mounted in the housing adjacent an access slot 32 formed in the front wall 18 and has its slide control button 34 shown therein in the off position. The button 34 is entrapped within a recess 36 to move with a switch actuator 38 slidably mounted and held in position within vertical side grooves 40 formed in the housing 12, as depicted in FIGS. 2 and 3. The actuator 38 has a plate portion 42, and a knob portion 44 which extends outwardly of the access slot 32 for convenient operation, as shown in FIGS. 1 and 3. The plate portion 42 bears indicia on its front side which is viewable through the access slot 32 to indicate whether the position of the switch 30 is "on" as shown in FIG. 4, or "off" as shown in FIG. 3. The switch 30 is connected in circuit with the motor 24 as by leads 46 and 48, and placing the switch 30 in the on position will actuate the motor 24.

The switch actuator 38 has a pair of tabs 50 and 52 extending from either side of the plate 42 along a length thereof approximately equal to that of the knob 44. The tabs 50 and 52 are confined within the vertical side grooves 40, 40 formed in the housing on opposite sides of the switch 30, and illustrated in FIGS. 3 and 4, so as to limit the movement of the switch actuator 38 and the switch button 34 to a vertical reciprocal motion corresponding to the on or the off positions of the switch 30.

Figure 5:
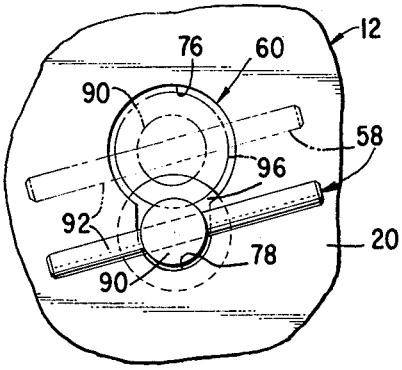
FIG. 5 is a fragmented side elevational view showing the chuck key seated within the socket.

The plate 42 has a leading edge 54 at its upper end which will contact a guard 56 formed of a resilient metal spring strip which as seen in FIGS. 2 and 3, will block the motion of the switch actuator 38 and prevent the switch 30 from being shifted from the off position to the on position. This will always occur as depicted in FIGS. 1, 2 and 3, when the chuck key 58, shown only in FIGS. 4 and 5, is absent the socket 60.

The guard 56 best seen in FIG. 2 is formed in the serpentine shape of an inverted S with a short transverse horizontal leg 62 formed at one end thereof, adjacent the leading edge 54 of the switch actuator 38, and a long transverse horizontal leg 64 formed at the other end thereof and terminating in an enlarged mounting tab 66. An intermediate length transverse horizontal leg 68 as shown in FIG. 2, has its right end bent downwardly to form a short vertical leg 70 that terminates in the leg 62, and has its left end bent upwardly to form a larger vertical leg 72, which in turn, terminates in the leg 64 so as to form one continuous strip 56. The tab 66 end of the guard 56 abuts a boss 74 formed on the interior side of the front wall, and is connected thereto by a screw 75, as shown in FIG. 3, and rightwardly of the access slot 32 as shown in FIG. 2. The socket 60 is formed in the side wall 20 and extends inwardly in the direction of the boss 74. The socket 60 defines a keyhole aperture having a larger diameter upper circular opening 76 which intersects a lower smaller diameter substantially circular opening 78. The upper opening is bounded by a wall portion 80, and the lower opening is bounded by a wall portion 82. The wall portion 80 is longer than the wall portion 82 and extends far enough inwardly to envelop the long horizontal leg 64 of the guard 56.

The lower wall portion 82 is cut off by a slabbed interior wall 84 illustrated in FIGS. 2 and 4 which slopes upwardly and inwardly from the bottom of the lower wall portion 82 to terminate short of the midpoint of the upper opening 76. The wall 84 defines a cam surface for purposes more fully explained hereinafter.

In the preferred embodiment of the invention shown in FIGS. 2 and 3, the leading edge 54 is just out of engagement with the short leg 62, so as to form a clearance space 86, while a second clearance space 88 is formed between the long leg 64 and the wall 80. The clearances 86 and 88 are very small, so as not to interfere with the operation or purpose of the present invention, but of course, could be eliminated if desired. The switch actuator as depicted in FIGS. 2 and 3, will remain in the off position, because any attempt to vertically shift the switch actuator 38 upwardly will be prevented by the guard 56. Upon an operator attempting to move the switch actuator 38 vertically upwardly, the leading edge 54 thereof will contact the leg 62 causing the motion to be transmitted via the vertical legs 70 and 72 to the upper leg 64 to bring the same into contact with the wall 80.

The guard 56 has each of its segments relatively stiff, with the shorter members stiffer than the longer members. Any attempt to vertically move the switch actuator 38 will be blocked by the stiffness of the guard 56 and the segments thereof, except for the initial movement which may occur to use up the clearances 86 and 88, thus to bring the guard 56 into engagement between the leading edge 54 and the wall 80. With the guard 56 in position as shown in FIGS. 2 and 3, it is as if the leading edge 54 were abutting the wall 80, so as to prevent vertical motion upwardly of the switch actuator 38 and consequently the slide control button 34 is prevented from moving, and the switch 30 is forced to remain in the off position.

The chuck key 58 illustrated in FIGS. 4 and 5, includes a shank 90 having a handle 92 affixed through a hole at one end thereof, and a pilot 94 formed at the other end thereof. A pinion 96 is formed at the pilot end of the shank 90, a short distance inwardly of the end thereof. The pilot 94 fits in a hole 98 of the chuck 28 shown in FIG. 1, and the pinion 96 would mate with the teeth of the bevel gear 100 so that when the operator twisted handle 92 in one direction or the other, the gear 100 would be rotated to axially shift the jaws 102 open or closed responsive to the respective direction of rotation.

The shank 90 has a predetermined diameter so that the diameter of the pinion 96 is larger and the diameter of the pilot 94 is smaller. As best seen in FIG. 5, the diameter of the upper opening 76 is slightly larger than the diameter of the pinion 96, while the diameter of the lower opening 78 is somewhat smaller than that of the pinion 96 but is slightly larger than the diameter of the shank 90. This permits the chuck key 58 to be insertable through the upper opening 76, so that once inserted, a vertical movement downward will place the shank 90 within the lower opening 78. Of course, the chuck key 58 must be inserted sufficiently to permit the flat-sided rear wall of the pinion 96 to come into contact with the sloped wall 84, else the unmatched diameters of the lower opening 78 will prevent insertion of the pinion 96 therein. Upon insertion of the chuck key 58 into the upper opening 76 of the socket 60, the pilot 94 will contact the upper vertical leg 72 to cause the guard 56 to buckle and deflect sufficiently inwardly in the direction of the boss 74 to remove the short leg 62 from the path of travel of the leading edge 54 of the switch actuator 38, as depicted in FIG. 4. The guard 56 is thus moved out of the way to unblock the free operation of the switch actuator 38, enabling the same to be vertically shifted from the off position shown in FIG. 2, to the on position shown in FIG. 4, whereby the slide control button 34 will move correspondingly to turn the switch 30 on or off in response to the relative position of the switch actuator 38.

Insertion of the chuck key 58 into the socket 60 produces a shifting of the guard 56 in a downwardly and inwardly direction, and causes a certain amount of spring pressure to be exerted against the pilot 94 to hold the same against the sloped wall 84 of the socket 60. In addition to the biasing pressure, there is a certain natural resistance caused by the shape assumed by the guard wherein the long vertical leg 72 slopes upwardly and outwardly as seen in FIG. 4, which is in comparison to the slope wall 84 which is sloping upwardly and inwardly. Either the slope of wall 84 or leg 72 would be sufficient to hold the chuck key 58 within the lower opening 78 of the socket 60 in that the pinion 96 bears against the wall 84, so as to require a vertical motion upwardly to free the chuck key 58 from the socket 60. Because of the respective slopes, the vertical motion of the chuck key 58 will be a guided motion slightly inwardly to free the same from the cam surface defined by the wall 84, against which the pinion 96 has been held by the guard 56. When the chuck key 58 is seated in the lower opening 78 the shank 90 has a full line contact therein because the interior surface of the wall 82 is formed at a right angle with the sloped wall 84.

So long as the chuck key 58 remains seated within the socket 60 in the position shown in FIG. 4, the switch actuator 38 may be freely operated. However, upon the operator desiring to change the bit within the chuck 28, removal of the chuck key 58 will be necessary. Thereafter, once the chuck key 58 has been removed from the socket 60, the safety feature of the present invention comes into play. The operator cannot now vertically move the switch actuator from the off position to the on position, as such movement is blocked by the guard 56 as illustrated in FIGS. 2 and 3. Thus, it becomes virtually impossible for the operator to negligently leave the chuck key 58 in the chuck 28, as the drill press 10 cannot be activated until the chuck key 58 is replaced and seated in the socket 60.

It will be understood that various changes in the details, materials, arrangements of parts and operating conditions which have been herein described and illustrated in order to explain the nature of the invention, may be made by those skilled in the art within the principles and scope of the invention.

Having thus set forth the nature of the invention, what is claimed herein is:

1. A safety system for a drill operated by an electric motor journaled in a housing to rotate a bit-carrying chuck, said safety system comprising:

a. a switch mounted in a side wall of the housing, and connected in circuit to actuate the motor, b. the switch being slidable along a lineal path of travel to be moved between a normally "off" position at one end of its travel, and an "on" position at the other end of its travel, c. a resilient guard means yieldably mounted in the housing, d. the guard means intersecting the path of travel of the switch normally to prevent the switch from being moved along the lineal path of travel to force the switch to remain in the normally "off" position, e. a socket formed in a side wall of the housing adjacent the guard means, f. the socket including a pair of intersecting substantially circular apertures of different diameters, with the upper one larger than the lower one, g. a chuck key having a shank terminating at one end in an enlarged pinion, and at the other end in a handle, and h. the pinion end of the chuck key being inserted into the upper aperture with the shank substantially horizontal to define a first lineal motion, and the pinion end being moved vertically downwardly into the lower aperture to define a second lineal motion substantially perpendicular to the said first motion with the shank to remain horizontal, and to cause the pinion end to engage and to remove the guard means from the lineal path of travel of the switch whereby the switch is free to be actuated at will, while the chuck key is clamped in the lower aperture by its pinion end being entrapped between the lower aperture and the resilient guard.

2. The combination claimed in claim 1 wherein:

a. the resilient guard includes a serpentine spring strip, b. one end of the strip is mounted to the housing opposite the socket, c. the wall of the socket having the enlarged diameter extends over the transverse leg of the strip opposite the mounting thereof, d. a second leg of the strip extends across the socket for engagement by the chuck key upon its insertion into said socket, e. the end of the strip opposite the mounting thereof is a short transverse leg which acts to block the travel of the switch whereby on attempting to slide the switch from the "off" to the "on" position the physical movement of the switch will shift the strip onto contact with the socket wall and prevent further motion of said switch, thus preventing the switch from being actuated.

3. The combination claimed in claim 1 wherein:

a. the outer wall of the socket is vertical and the inner wall of the socket is sloped downwardly and away from the spring strip to define a camming surface which self-supportingly holds the pinion of the chuck key after insertion thereof.

* * * * *